US008337118B2

(12) United States Patent
Buschmann et al.

(10) Patent No.: US 8,337,118 B2
(45) Date of Patent: Dec. 25, 2012

(54) ROAD FINISHER

(75) Inventors: Martin Buschmann, Neustadt (DE); Steffen Fickeisen, Bad Duerkheim (DE)

(73) Assignee: Joseph Vögele AG, Ludwigshafen/Rhein (DE)

( * ) Notice: Subject to any disclaimer, the term of this patent is extended or adjusted under 35 U.S.C. 154(b) by 66 days.

(21) Appl. No.: 12/723,766

(22) Filed: Mar. 15, 2010

(65) Prior Publication Data

US 2010/0296867 A1 Nov. 25, 2010

(30) Foreign Application Priority Data

May 20, 2009 (EP) ..... 09006845

(51) Int. Cl.
*E01C 23/07* (2006.01)

(52) U.S. Cl. ..... 404/84.5; 404/84.1; 404/84.05

(58) Field of Classification Search ..... 404/84.05, 404/84.1, 84.5, 108
See application file for complete search history.

(56) References Cited

U.S. PATENT DOCUMENTS

| | | | | |
|---|---|---|---|---|
| 3,873,226 | A * | 3/1975 | Teach | 404/84.5 |
| 3,953,145 | A * | 4/1976 | Teach | 404/84.5 |
| 5,529,434 | A * | 6/1996 | Swisher, Jr. | 404/108 |
| 5,749,783 | A | 5/1998 | Pollklas | |
| 5,921,708 | A * | 7/1999 | Grundl et al. | 404/84.1 |
| 2009/0044505 | A1 | 2/2009 | Huster et al. | |
| 2010/0215433 | A1 * | 8/2010 | Fritz | 404/84.5 |

FOREIGN PATENT DOCUMENTS

| | | | |
|---|---|---|---|
| DE | 297 15 467 | U1 | 10/1997 |
| DE | 202005004049 | U1 | 7/2005 |
| EP | 0760202 | A1 | 3/1997 |
| EP | 2020174 | A1 | 2/2009 |
| FR | 2625237 | A1 | 6/1989 |

* cited by examiner

*Primary Examiner* — Gary S Hartmann
(74) *Attorney, Agent, or Firm* — Fish & Richardson P.C.

(57) ABSTRACT

A road finisher (1) and a mobile supply unit (4) are described, between which a feed conveyor (7) with a discharge end (7*a*) is provided. Road finisher (1) and supply unit (4) are movable independently of each other in travel direction (F), and their relative positions with respect to each other can be detected by a sensor means (8, 18). To automate such a system as much as possible and to make it useable under all paving situations, it is suggested that the sensor means (8, 18) should include a position sensor (9) which has assigned thereto at least two mutually spaced-apart reference elements (10) for determining the position of the discharge end (7*a*) in, and transversely to, the direction of travel (F).

16 Claims, 4 Drawing Sheets

ROAD FINISHER

BACKGROUND OF THE INVENTION

The present invention relates to a road finisher with a mobile supply unit between which a feed conveyor having a discharge end is provided.

Such a road finisher is known from DE 297 15 467 U1. The known road finisher forms part of a paving train in which all of the road finishers of the paving train are fed via an independently driven feeder preceding the road finisher. The feeder is provided with a feed conveyor in the form of a conveyor belt that reaches up to and over the bunker for the paving material of the succeeding road finisher and fills the bunker of said road finisher with paving material. The feeder is equipped with a pivot belt that enables the feeder to travel not only directly, but also in a laterally offset way, in front of the finisher. A plurality of sensors are provided that are arranged on the feeder, on the road finisher and on the feed conveyor to control positioning and distance of the feeder relative to the road finisher, and the signals determined by the sensors are here used for controlling the components of the paving train. A pair of sensors is e.g. arranged at the side of the road finisher that is the front one in travel direction and at the side of the feeder that is the rear one in travel direction, with the distances of both units being here determined. A further pair of sensors is provided at the discharge end of the feed conveyor and in the bunker of the road finisher; the fill condition of the bunker is here to be determined. However, despite a sensor control, problems may arise during transfer when the operator misses the container of the finisher and the paving material drops next to, in front of, or on the finisher. This may considerably disturb the paving process.

It is the object of the present invention to provide a road finisher and a mobile supply unit, wherein the transfer process can be carried out in a substantially automated way and under all paving situations.

SUMMARY OF THE INVENTION

The object of the present invention is achieved with the features set forth below.

Owing to the configuration according to the invention it is possible to determine the relative position between the supply unit and the road finisher in, and also in a direction transverse to, the direction of travel, i.e. also in cases where the supply unit is offset relative to the road finisher in a direction transverse to the direction of travel. It is thereby possible to place the bulk cone of the paving material independently of the relative position, particularly independently of an orientation transverse to the direction of travel, of supply unit and road finisher at an exactly defined position in the bunker of the road finisher.

Advantageous developments provided by the present invention are set forth below.

It is of particular importance when, in addition to the determination of the position of the discharge end in, and transversely to, the direction of travel (x- and y-direction), the position of the discharge end can also be determined in z-direction, i.e. at the height distance above the bulk cone. It is thereby possible to keep the distance between the discharge end and the bulk cone substantially constant with all sizes of the bulk cone, so that the whole amount of conveyed material shows the same path of fall through free air and is thus cooled in a uniform way. If the distance is then kept sufficiently small, the cooling action in the paving material during the transfer operation can be diminished. Moreover, a de-mixing of the material during transfer is minimized.

BRIEF DESCRIPTION OF THE DRAWINGS

Embodiments of the present invention shall now be explained in more detail with reference to the drawings in which.

DETAILED DESCRIPTION OF THE INVENTION

Figure 1:
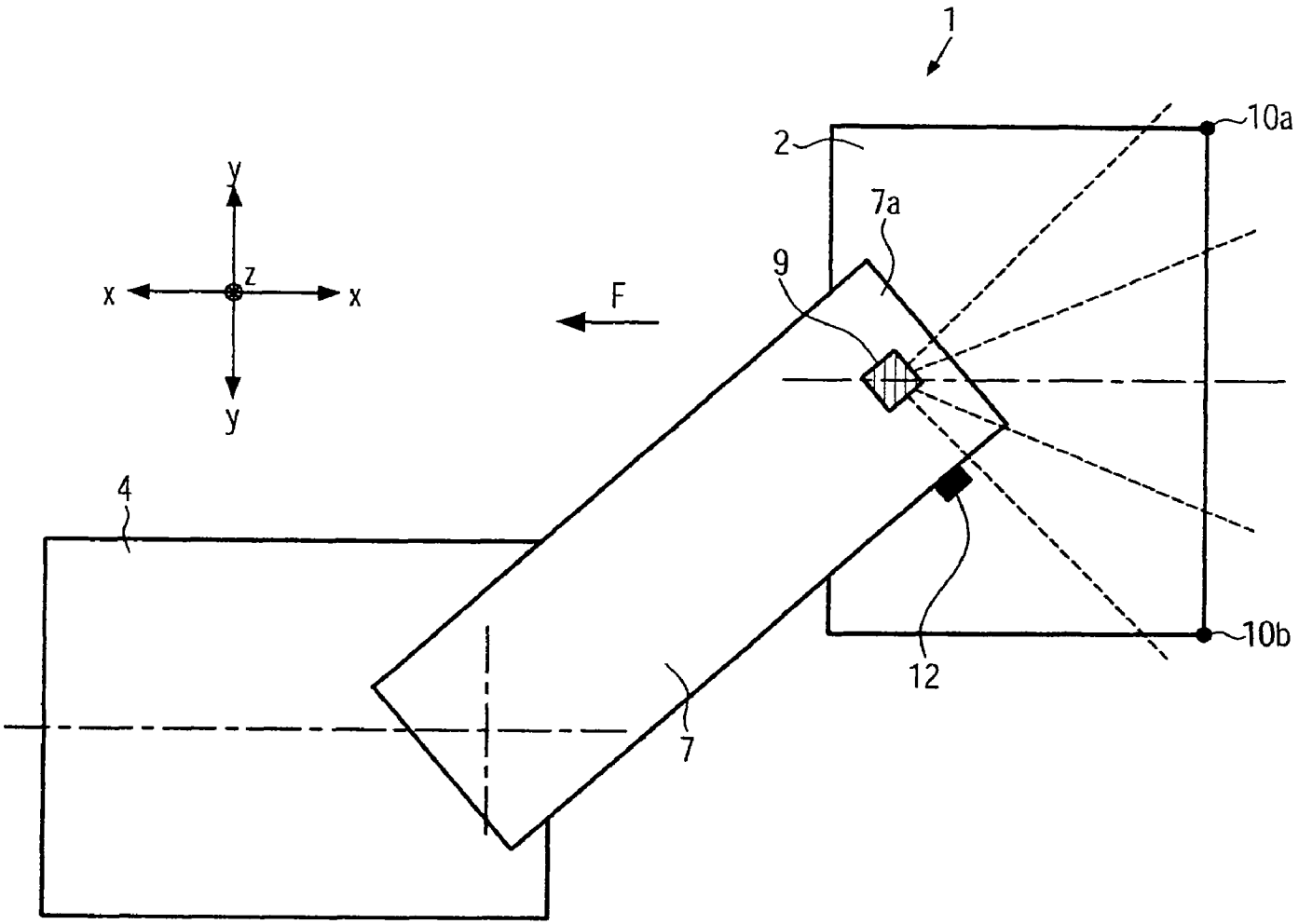
FIG. 1 is a strongly schematized top view on a first embodiment of the invention.

FIG. 1 is a top view and strongly schematized illustration showing a road finisher 1, of which just the bunker 2 for receiving paving material (road construction material) is here shown. The road finisher 1 shows the standard design, i.e., it is provided with the bucket, reservoir or bunker 2 positioned at the front in travel direction F, which feeds the paving unit via appropriate conveying means, such as scraper belts. The road finisher 1 comprises a chassis 3 (a tracked chassis is shown) and a drive with which the road finisher 1 can be moved independently. The bunker 2 has a predetermined and known geometry (length, width, height, shape).

A supply unit 4, which may e.g. be a truck or, as shown, a feeder which is adapted to the special purpose of use, moves in front of the road finisher 1. Feeder and road finisher may e.g. be configured in the way shown in DE 297 15 467 U1. The supply unit 4 also contains a storage bin 5 with paving material and a chassis 6 with a drive of its own, so that the supply unit 4 can be moved independently of the road finisher 1. The transfer connection for the paving material between the supply unit 4 and the road finisher 1 is established via a feed conveyor 7, which may e.g. be configured as a conveyor belt, as shown in the aforementioned DE 297 15 467 U1, and is assigned to the mobile supply unit. The feed conveyor 7 is optionally pivotable about a horizontal and/or vertical axis.

Figure 2:
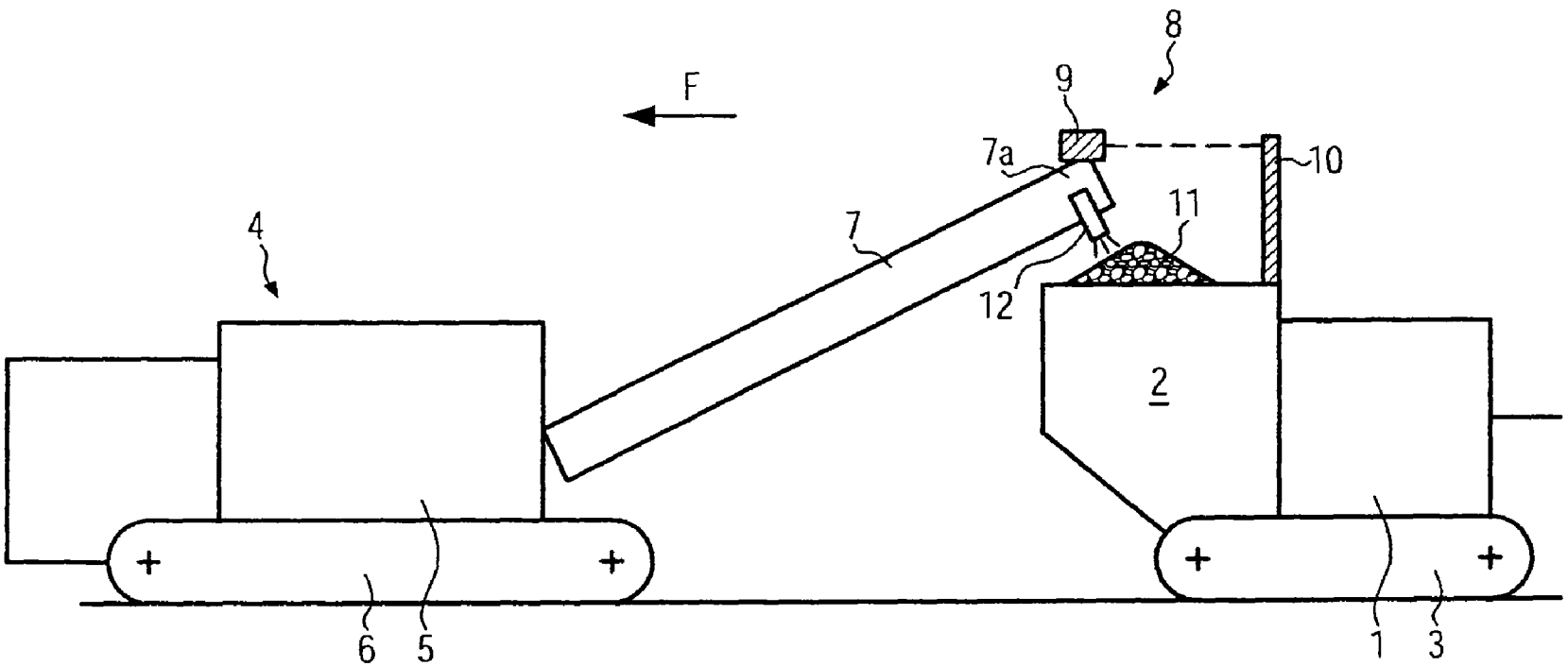
FIG. 2 is a strongly schematized side view of the embodiment according to FIG. 1.

A sensor means 8 is provided for positioning the supply unit 4 and the road finisher 1 relative to each other. In the illustrated embodiment, the sensor means 8 comprises a position sensor 9 cooperating with two reference elements 10. In the illustrated embodiment the position sensor 9 is provided at the discharge end 7*a* of the feed conveyor 7 and directed towards reference elements 10*a* and 10*b*, which are arranged at the side of the bunker 2 that is the rear one in travel direction F. In the illustrated embodiment the reference elements 10 are configured as rods, or are mounted thereon, which can project beyond a maximum bulk cone 11 (FIG. 2) in the bunker 2 and can thereby be sensed by the position sensor 9 at the discharge end 7*a*, i.e. the position sensor 9 and at least corresponding parts of the reference elements 10 are positioned at each angular position of the discharge end 7*a* in a horizontal plane. The reference elements 10*a*, 10*b* are spaced apart from each other, namely to such an extent that they can be sensed separately by the sensor 9. In the illustrated embodiment, the reference elements 10*a*, 10*b* are spaced apart in a direction transverse to the travel direction F, i.e. preferably at a right angle thereto. A preferred distance is the width of the bunker 2 in a direction transverse to the travel direction. Hence, with the position sensor 9 the x- and y-coordinates can be determined in spatial direction, i.e. the relative position of discharge end 7*a* and bunker 2, with or without consideration of a fall parabola.

Furthermore, the sensor means 8 contains a distance sensor 12 which detects the distance between the sensor 12 and the bulk cone 11. For this purpose the sensor 12 is also arranged at or near the discharge end 7*a* of the feed conveyor 7 and directed into the bunker 2. Hence, with said distance sensor 12 the z-coordinate in spatial direction is determined, with or without consideration of a fall parabola, so that with the design according to the invention an orientation of the assignment of supply unit 4 and road finisher 1, more exactly of the discharge end 7*a* to bunker 2, can be accomplished in all of the three dimensional directions.

The signals supplied by the sensors are supplied to the control device and are used and/or displayed either for automatically controlling the supply unit 4 and/or the feed conveyor 7 in x- and y-direction, so that a manual correction is possible with given deviations. Moreover, the discharge end 7*a* of the feed conveyor 7 in z-direction is also controlled via the distance sensor 12, e.g. by pivoting the feed conveyor 7 about a horizontal axis, in such a way that the discharge end 7*a* always shows substantially the same distance from the growing bulk cone 11 in the bunker 2.

Figure 3:
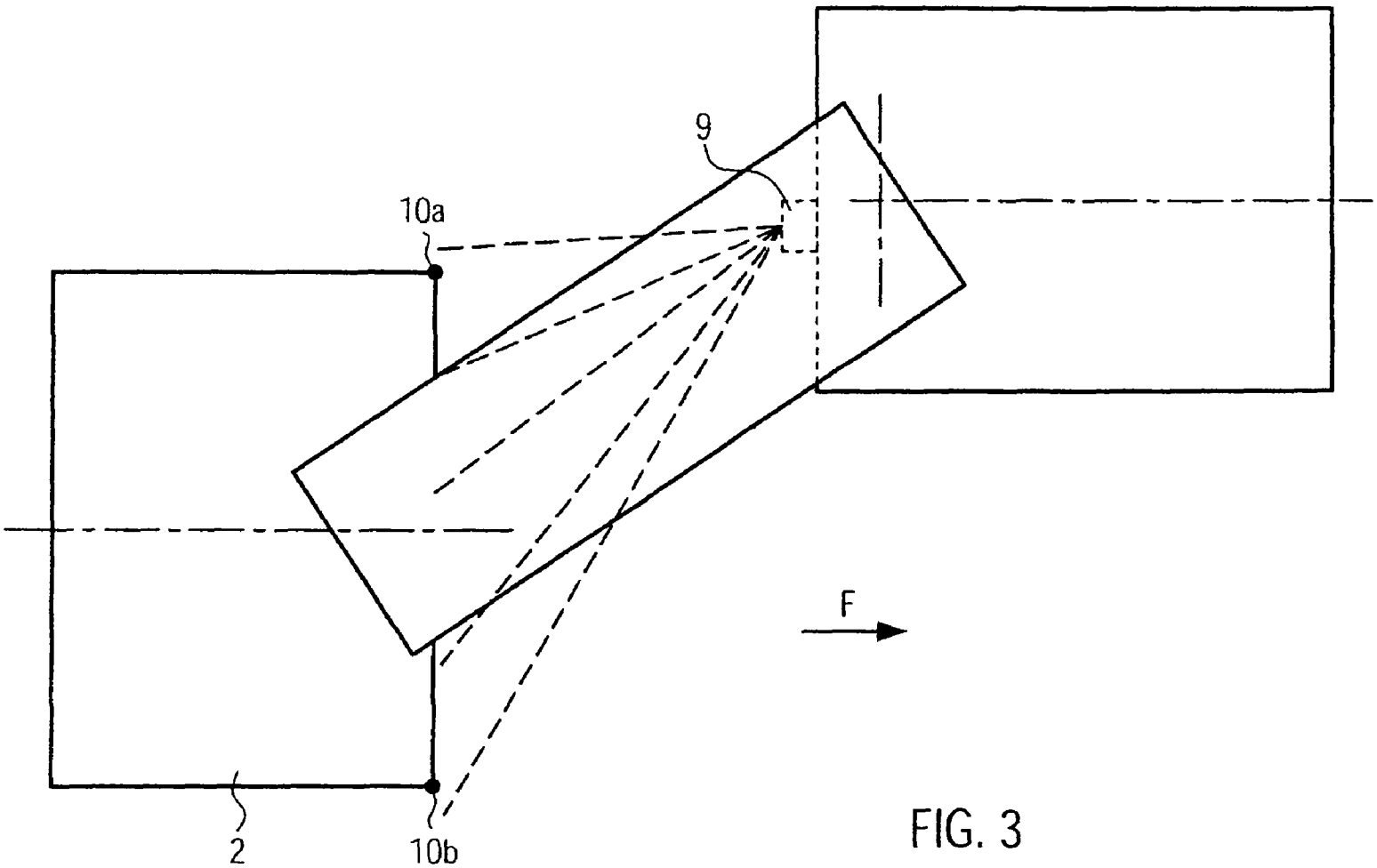
FIG. 3 is a strongly schematized top view on a second embodiment of the invention.
Figure 4:
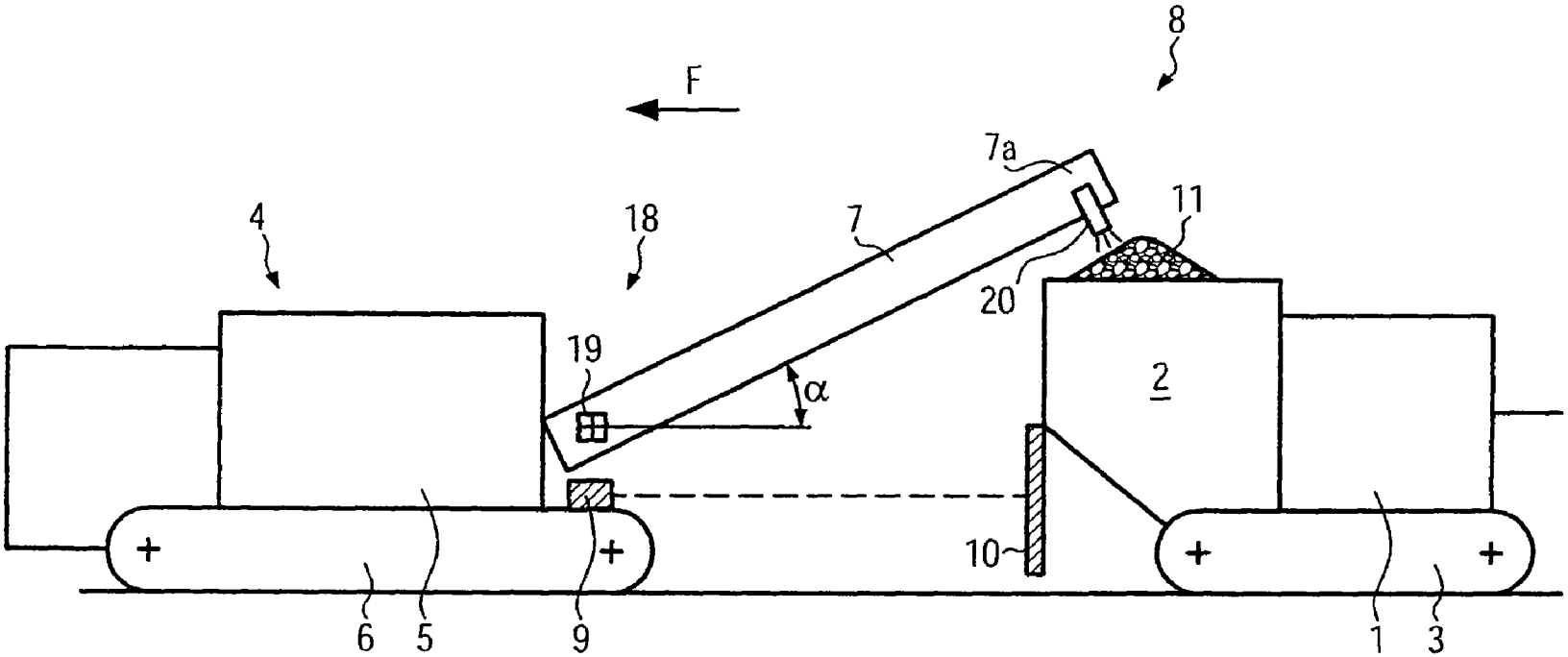
FIG. 4 is a strongly schematized side view of the embodiment according to FIG. 3.

FIGS. 3 and 4 show a further embodiment of the invention, where identical or comparable components are marked with identical reference numerals and are not explained once again. The embodiment according to FIGS. 3 and 4 differs from the embodiment according to FIGS. 1 and 2 by a modified sensor means 18. The sensor means 18 also comprises a position sensor 9 which is directed towards reference elements 10, but the position sensor 9 is arranged at the side of the supply unit 4 itself, which side is the rear one in travel direction F, (and is thus not arranged in a vertically movable way) and is oriented towards reference elements 10 that are secured to the side of the road finisher 1 that is the front one in travel direction F, particularly to the bunker 2. Distance and configuration of the reference elements 10*a* and 10*b*, respectively, are the same as described with reference to the preceding embodiment. Likewise, the position sensor 9 has the described configuration and mode of operation. In this instance, too, the position sensor 9 and the reference elements 10 are positioned in a joint, substantially horizontal plane.

The sensor device 18 additionally includes an angle transmitter 19 which detects the angular position a of the feed conveyor 7 about a horizontal axis relative to a reference plane and thereby defines the distance of the discharge end 7*a* from the bulk cone 11 and lifts the feed conveyor 7 in proportion to the rising bulk cone 11. With the help of the angle $\alpha$ measured by the angle transmitter 19 and of the already known and predetermined geometry (particularly of the bunker 2 and the feed conveyor 7), the discharge point can be easily determined. Due to the known geometry of the bunker 2 the distance between discharge end 7*a* and bunker 2 can further be determined. When the bunker 2 is being filled up and the distance between the discharge end 7*a* and the bulk cone 11 falls below a specific value, the feed conveyor 7 is lifted, so that the distance between bulk cone 11 and discharge end 7*a* remains the same. When the bulk cone 11 is decreasing in size, the discharge end 7*a* will drop until a minimum distance has been reached between the bunker 2 and the discharge end 7*a*. Said minimum distance between the discharge end 7*a* and the fill level of the bunker is accomplished, for instance in the same way as in the first embodiment, with the help of the overfill sensor 20. For checking purposes an overfill sensor 20 is provided and preferably arranged at the discharge end 7*a*, the sensor making sure that the bunker 2 will not be overfilled. Hence, in this embodiment it is also possible to define a position of the discharge end 7*a* in the three spatial directions in a simple way.

The sensors used are preferably laser or ultrasonic sensors with reflectors as reference elements; however, very different measuring systems could also be used. For instance, a direct distance measurement of the discharge end 7*a* to the bulk cone 11 in x/y/z direction can be carried out with ultrasonic, optical, magnetostrictive, mechanical (cable pull) displacement pick-ups, or other sensors. Likewise, a differential distance measurement of the discharge point at the discharge end 7*a* and of the reception point on the bulk cone 11 is possible as a difference between two absolute position definitions of discharge point and reception point, e.g. by a laser total station, GPS, or the like. The construction of a simple differential GPS with a GPS antenna at the discharge place and one at the reception point is particularly advantageous. Simple and inexpensive systems can here be used that, despite a low absolute accuracy, show a high relative accuracy because with this task only a relative position is needed. Furthermore, an indirect distance measurement discharge point/reception point is possible by measuring the distance between inclination angles with the above-described systems, preferably magnetostrictively. It is then possible to calculate the relative position of discharge point/reception point from these values and the geometry of the machine.

The determined positions are compared in a processing unit (not shown) of the control device with the desired positions and are passed on in appropriate steering commands to the actuators.

Furthermore, a number of control elements on the supply unit can be used to zero the control errors of the measurements, e.g. the travel drive speed (delta in x-direction), the steering or differential speed of the chassis tracks in the case of tracked vehicles (offset+delta in y-direction), the mass flow of the conveyor system, e.g. through the conveyor speed (change in the fill level in the bunker), the pivot drive of the conveyor device (delta in y-direction, errors in x-direction are negligible) or the pitching drive of the conveyor system (delta in z-direction, errors in x-direction are negligible).

Apart from the feeding of road finishers with paving material, the invention can also be used for other applications, for instance for holding the discharge position when filling trenches, for measuring and controlling the fill level when filling trenches, for positioning the discharge point in alternative discharge positions, e.g. in paving trains with two grades of asphalt and two material bunkers, for maximizing the fill level in the bunker of the finisher through a defined distribution of the material, during unmanned operation of the supply unit or the road finisher, on the occasion of a teach-in function for the relative or absolute position of discharge point and/or reception point, or during the defined transverse distribution of concrete in front of a slipform paver.

The invention claimed is:

1. A road finisher and mobile supply unit between which a feed conveyor with a discharge end is provided, said road finisher and supply unit being movable independently of each other in a travel direction, and their relative positions with respect to each other being detectable by a position sensor which cooperates with at least two mutually spaced-apart reference elements for determining the position of the discharge end of the feed conveyor in, and transversely to, the direction of travel.

2. The road finisher and mobile supply unit according to claim 1, wherein the reference elements are spaced apart in a direction transverse to the direction of travel.

3. The road finisher and mobile supply unit according to claim 1, wherein the position sensor and the reference elements are positioned substantially in a joint horizontal plane.

4. The road finisher and mobile supply unit according to claim 1, wherein the reference elements contain reflectors for reflecting signals output by the position sensor.

5. The road finisher and mobile supply unit according to claim 1, wherein the position sensor comprises a laser sensor.

6. The road finisher and mobile supply unit according to claim 1, wherein the position sensor is arranged at the discharge end of the feed conveyor.

7. The road finisher and mobile supply unit according to claim 1, wherein the position sensor is arranged on the supply unit outside the discharge end.

8. The road finisher and mobile supply unit according to claim 1, wherein the sensor means comprises a distance sensor for determining the vertical distance of the discharge end from a bulk cone.

9. The road finisher and mobile supply unit according to claim 8, wherein the distance sensor is arranged on the feed conveyor.

10. The road finisher and mobile supply unit according to claim 8, wherein the distance sensor comprises a laser sensor or ultrasonic sensor.

11. The road finisher and mobile supply unit according to claim 1, wherein the feed conveyor is pivotable about a substantially horizontal axis, and an angle transmitter is assigned to the feed conveyor.

12. The road finisher and mobile supply unit according to claim 1, wherein the feed conveyor is pivotable about a substantially vertical axis, and an angle transmitter is assigned to the feed conveyor.

13. The road finisher and mobile supply unit according to claim 1, wherein the feed conveyor is pivotable about substantially horizontal and vertical axes, and an angle transmitter is assigned to the feed conveyor.

14. The road finisher and mobile supply unit according to claim 2, wherein the position sensor and the reference elements are positioned substantially in a joint horizontal plane.

15. A road finisher and mobile supply unit between which a feed conveyor with a discharge end is provided, said road finisher and supply unit being movable independently of each other in travel direction comprising:

a position sensor for detecting the relative position of the supply unit and the road finisher with respect to each other which cooperates with at least two mutually spaced-apart reference elements for determining the position of the discharge end in, and transversely to, the direction of travel, and distance sensors for determining the vertical distance of the discharge end from a bulk cone.

16. The road finisher and mobile supply unit according to claim 15, wherein the distance sensor is arranged on the feed conveyor.

* * * * *